US005478392A

United States Patent [19]

Hooykaas

[11] Patent Number: 5,478,392

[45] Date of Patent: Dec. 26, 1995

[54] POROUS GRANULATED STEEL SLAG COMPOSITION AND USE OF SUCH AS AGGREGATE OR CEMENT REPLACEMENT IN BUILDING MATERIALS, ROAD BUILDING AND EMBANKMENT

[75] Inventor: Carel W. J. Hooykaas, Rotterdam, Netherlands

[73] Assignee: Pelt & Hooykaas B.V., Rotterdam, Netherlands

[21] Appl. No.: 264,421

[22] Filed: Jun. 23, 1994

Related U.S. Application Data

[63] Continuation of Ser. No. 965,236, Oct. 23, 1992, abandoned.

[30] Foreign Application Priority Data

Oct. 23, 1991 [NL] Netherlands ..... 9101771

[51] Int. Cl.[6] ..... C04B 28/08

[52] U.S. Cl. ..... 106/789

[58] Field of Search ..... 106/707, 789, 106/403, 456; 266/227

[56] References Cited

U.S. PATENT DOCUMENTS 4,124,404 11/1978 Suzuki et al. ..... 106/767
4,174,961 11/1979 Wolfs et al. ..... 106/707

FOREIGN PATENT DOCUMENTS 3609568 9/1987 Germany ..... C04B 7/153
3626772 2/1988 Germany .
3915373 12/1989 Germany .
3242950 10/1988 Japan .
1167266 6/1989 Japan .

OTHER PUBLICATIONS

Sharanov et al., "Slag Granulation at Blast Furnace", 2283 *Steel in the USSR,* Aug. 1981, pp. 455–458.
Manual of Concrete Practice, "Grand Granulated Blast Furance Slag as a Cementitious Constituent in Concrete", ACI 226.1R–87, 1987, sections 1.4–1.7 (no month).
World Patents Index, SU–367064 1973: "Molten Slag Treatment . . . ". (no month).
*Chemical Abstracts,* 55747x vol. 115, No. 6 (Columbus, Ohio 1991). p./No. 6001 (no month).
*Chemical Abstracts,* 134036u vol. 109, p. 311 (Oct. 1988).
Cooper et alia, "Blast Furnace Slag Granulation". *Iron and Steel Engineer,* vol. 63, No. 7 (Jul. 1986).

*Primary Examiner*—Mark L. Bell
*Assistant Examiner*—Michael Marcheschi
*Attorney, Agent, or Firm*—Levine & Mandelbaum

[57] ABSTRACT

The invention relates to a porous granulated steel slag having a weight per unit volume of less than 1 kg/dm$^3$ in the loosely dumped state and of 0.99 kg/dm$^3$ in the compacted dumped state, having a free calcium oxide content of at most 1/10 of the content in the non-granulated slag. The present steel slags are obtained by spraying a molten stream of steel slag with a sprayed pressurized stream of water. After comminuting, for example by grinding, and removal of iron, the porous granulated steel slag can be separated into a ferrite-richer fraction, which can serve as raw material for steel production, and a lower-ferrite fraction, which can serve as raw material for an inorganic binder. Granulated steel slag is also used as aggregate in building materials, as raw material in road building materials and for embankment materials, and as cement replacement material.

10 Claims, No Drawings

POROUS GRANULATED STEEL SLAG COMPOSITION AND USE OF SUCH AS AGGREGATE OR CEMENT REPLACEMENT IN BUILDING MATERIALS, ROAD BUILDING AND EMBANKMENT

This application is a continuation of application Ser. No. 07/965,236, filed on Oct. 23, 1992 now abandoned.

BACKGROUND OF THE INVENTION

1. Field of the Invention

The invention relates to slag.

2. Prior Art

It is generally known to convert iron products obtained from a blast furnace into steel in a converter, for example by blowing through oxygen. During this treatment a steel slag is formed which, however, has various disadvantages which impede the use in practice.

Firstly, mention may be made of the particularly high content of free calcium oxide, as a result of which, when this slag is processed in road building materials, cracks can form in a road surface when the calcium oxide is converted into calcium hydroxide. This consequently leads to accelerated deterioration of a road surface made using such a slag.

Another disadvantage is the high weight per unit volume of 2,000 kg/m$^3$.

Finally, this slag is difficult to process after solidification, since it must first be broken and screened in order to obtain usable particles of from 0 to 25 mm in size.

For all of these reasons there has been insufficient interest in steel slag hitherto. Heretofore, virtually the only known made for processing such steel slag was by mixing it with blast furnace slag and granulated blast furnace slag, 20% steel slag and 10% granulated blast furnace slag.

However, as a result of increasing processing of blast furnace slag in the cement industry, a much smaller amount of blast furnace slag is available for processing into a road building composition. As a result of this it is imperative to search for other applications for very large amounts of steel slag.

By way of illustration it may be mentioned that in the case of a relatively large processing unit for the conversion of pig iron into steel, about 450,000 tons of steel slag comprising about 300,000 tons of steel slag having a particle size of less than 25 mm becomes available. The coarser fraction, mainly measuring 40–180 mm, may be used in the hydraulic architecture. From the finer fraction only a minor amount thereof can be processed to road building material products by mixing it with blast furnace slag and granulated blast furnace slag, or it may be used as a gravel replacement in concrete and asphalt.

Heretofore, the finer fraction was used in the past as an agricultural fertilizer because of its high phosphorous content. Because of the use of richer iron ores, the phosphorous content has nevertheless been lowered. Further, the dispersion of the present heavy metals in the slag must be restricted in view of environmental measures. As yet there are no uses for the remainder of the slag.

SUMMARY OF THE INVENTION

It has now been found that the abovementioned disadvantages occasioned by the too high concentrations of free calcium oxide in steel slag can be overcome by granulating the steel slag. In this way, a porous granulated steel slag is obtained which has a weight per unit volume of less than 1 kg per dm$^3$ in the loosely dumped state; in particular values of 0.77 kg/dm$^3$ can be achieved, whereas the weight per unit volume in the compacted dumped state is 0.99 kg per dm$^3$.

The free calcium oxide content in a porous granulated steel slag product hereof is at most 1/10, preferably 1/50, of the content in the non-granulated slag, more particularly less than 1.0%, and, especially, less than 0.2%.

In particular, in a steel slag the free calcium oxide content is reduced, on granulating to a porous granulated steel slag, from about 5 to 6% to 0.1%.

Moreover, the porous granulated steel slag obtained can be made more valuable by the magnetic removal of the iron from the granulated slag. This technique is know.

The slag which is obtained after removal of iron can the, surprisingly, easily be separated into two fractions after fine grinding; a first fraction with a higher ferrite content and a second fraction with a lower ferrite content. This separation is carried out magnetically. The fraction with the higher ferrite content can be used in this form, in a blast furnace, for the production of pig iron. The second fraction with the lower ferrite content can particularly advantageously be used for complete or partial replacement of cement since it has a Ca/Si ratio which is advantageous for this purpose.

Granulating steel slag therefore leads to the following advantages:

a) the weight per unit volume of the granulated porous steel slag product can be made much lower than 1 kg per dm$^3$;

b) the chemical composition of the granulated porous steel slag is greatly improved by a much lower free calcium oxide content; and c) by further removal of iron from the granulated steel slag it is possible, on one hand, to obtain a fraction which is lower in ferrites but has a Ca/Si ratio advantageous for use as an inorganic binder and, on the other hand, a fraction which is richer in ferrites and can be used as such for steel production.

DESCRIPTION OF THE PREFERRED EMBODIMENTS

By converting steel slag into a porous granulated steel slag it is therefore possible to use this type of slag as embankment materials since it has a lower density than that of water, when obtained by perfect granulation. As a result the embankment material can float on water because of the low weight per unit volume.

This porous granulated steel slag is also very suitable as road building material and as binder for partial or complete replacement of cement.

The porous granulated steel slag according to the invention can be obtained, in particular, by spraying a molten stream of steel slag with a sprayed, pressurized, atomized stream of water as a result of which the slag is broken apart. The amount of water is determined empirically and is usually about 4–8 tons of water per ton of molten steel slag composition. The same effect can be obtained by means of a rotating drum wherefrom water is squirted to the outside.

It is pointed out that granulation of blast furnace slags obtained in iron production in blast furnaces is known. But in this case the density of the blast furnace slag falls from 1,650 to 1,000 kg/m$^3$, whereas in the case of steel slag the density surprisingly can fall from 2,100 to as low as 770 kg/m$^3$.

It is also pointed out that quenching liquid steel slags to form granules is known, such as is taught in DE-A-3,609,568. However, in this case quenching is carried out by feeding the slag stream into an amount of water and not by spraying the liquid slags with a pressurized atomized stream of water. By spraying with an atomized pressurized stream of water, an appreciable lowering in the density of the steel slag is obtained, which cannot be obtained by quenching the slags in water. Moreover, according to the known method it is necessary, for use as cement, to finely grind the slag granules together with an amount of gypsum and/or anhydrite. The material obtained in this way acts as an activator in, for example, blast furnace cement.

It is also known that the presence of gypsum in cement leads to the formation of ettringite. However, set concrete, which contains ettringite, can show cracking if it comes into contact with sulphate-containing water, as a result of expansion of the ettringite, thus, it is highly desirable to restrict the amount of gypsum present in a cement mixture. The invention meets this aim.

Particularly advantageously, the present invention relates to a steel slag composition which is characterized in that a porous granulated steel slag is converted into comminuted form, for example, by grinding, as a result of which the steel slag can easily be separated into three fractions, each of which are valuable.

According to the invention, grinding is preferably carried out in the absence of substances which modify the lime content. Because of the Ca/Si ratio which exists in the treated steel slag, the extra addition of lime-containing substances in order to express the latent binding properties appears to be completely superfluous.

It has been found that when steel slags, such as [are] the obtained according to the invention, are used as hydraulically setting binders, the addition of gypsum to the mixture to be set can be dispensed with, or at least can be appreciably lowered. The addition of gypsum to slow setting and to enable a harder end product is obtained. This effect is obtained with the steel slags of the invention, without modification of the composition.

Ground, porous granulated steel slags can be processed easily in building materials such as sandlime brick, cellular concrete and normal concrete, as gravel-replacement material. They are also suitable as raw material for embankment materials because of the large volume and the low density, and, in particular because of the favorable Ca/Si ratio, as a constituent for cement. Moreover, when they are used as a constituent of cement savings can be made in respect of the required amount of Portland cement clinker or blast furnace granules.

Granulated steel slags also have the advantage that the amount of grinding energy required for cement preparation is appreciably lower, as normal air cooled steel slag.

The invention therefore also relates to the use of porous granulated steel slag, optionally in comminuted form, as an aggregate in building materials, as a raw material for embankment materials and as a raw material in an inorganic binder such as cement.

A particularly advantageous application is the use of granulated porous steel slag, optionally in comminuted form, as raw material for road building materials.

Particularly advantageously, a porous granulated steel slag according to the invention, optionally in comminuted form, is suitable as raw material for road building materials. In this case the ground porous granulated steel slag products serve as finely gradated aggregate for asphalt and concrete. Aggregates in the fine particle range are, for example, indispensable in an asphalt mixture for good matrix structure and are necessary to obtain good solidification of the bitumen and in order to ensure good adhesion. Lime-like substances, fly ashes or dust removal residues are frequently used as aggregates. However, the problem with these secondary raw materials is, that the quality is not constant in particular, fly ashes are less suitable because they are spherical and glassy because of the relatively high temperature in the electric power plants.

Porous granulated steel slag, in comminuted form, does not have these disadvantages, since they have a continuous particle size distribution, and are therefore of constant quality.

Moreover, as a result of the porous characteristics of granulated steel slag there is very good adhesion between bitumen and the steel slag particles. This, of course, also applies in the case of the use of steel slags and another binder, such as in building materials.

The invention, therefore, also relates to comminuted, and in particular ground, steel slag, the comminution being carried out in the absence of substances which modify the amount of lime. The Ca/Si ratio inherently present in the material is therefore kept essentially constant during comminution.

Finally, the invention provides building material products obtained by using a porous granulated steel slag, optionally in comminuted form, as an aggregate which is incorporated into the building materials.

EXAMPLE I

Steel slag originating from a steel converter is ground and the iron is removed with the aid of a magnet. After removal of the iron, a composition having the following screen analysis is obtained 0.063 mm: 51.1%

0.063–0.125 mm: 29.1%

0.125–0.25mm: 14.7%

0.25–0.5mm: 2.3%

0.5–1 mm: 0.9%

1–2 mm: 0.5%

2–4 mm: 1.4%

The composition of the slag can be seen from the analysis figures shown in TABLE I, below.

The slag is melted and then granulated by spraying with a pressurized water mist through nozzles.

The amount of pressurized water sprayed on is about 7 tons per ton of liquid steel slag composition.

To remove water adhering to the porous granulated slag, the composition is rotated in a perforated drum. The porous granulated slag so obtained has a weight per unit volume of 0.77 kg/dm$^3$ in the loosely dumped state and 0.99 kg/dm$^3$ in the firm compacted state.

This granulated slag is found to have a much lower free CaO content than the non-granulated slag, as shown in Table I.

Example II

Following the procedure of Example I, porous granulated steel slag is obtained. After crushing, the slag is processed in a composition for forming a bitumen road surface.

As a result of the low free calcium oxide content in the porous granulated steel slag, the road surface has a particularly long life since no cracks form as a result of absorption of water by the calcium oxide to form calcium hydroxide.

EXAMPLE III

Porous granulated steel slag obtained by the process of Example I is finely ground to a particle size of about 63. The iron present in this finely ground product is separated off magnetically and the finely ground product is then incorporated, as aggregate, in a bitumen composition for forming a road surface.

Very good adhesion between bitumen and ground steel slag particles is obtained as a result of the porous characteristics of the steel slag particles.

When a road surface of this type is used, no cracks occur because of a reaction between water and free calcium oxide. This is because of the low calcium oxide content in the porous granulated steel slag.

EXAMPLE IV

Porous granulated steel slag obtained by the process of Example I is ground to a particle size of about 63. The iron is removed from the steel slag, using a magnetic field.

The resulting steel slag is then subjected to a stronger magnetic field. This provides a first fraction which is richer in ferrites and a second fraction which is lower in ferrites.

The ferrite-rich fraction is recycled to the blast furnace, to replace iron ore.

The lower-ferrite fraction is granulated on a granulating tray using an aqueous binder to form granules. Alternately, the fraction can be granulated by a sintering process and thereafter granules are hardened to provide a gravel-replacement material.

EXAMPLE V

Sandlime brick is formed by incorporating thereinto a quantity equal to 20% of the weight of the product a 63 finely ground porous granulated steel slag produced by the process of Example I, into the composition for such a sandlime brick.

The characteristics of such sandlime brick are the same as those of normal sandlime brick.

EXAMPLE VI

Cellular concrete is formed by incorporating finely ground porous granulated steel slag obtained according to the process of Example I into the concrete mixture.

The building product obtained, in the form of a tile, has the same characteristics as concrete products obtained using ground normal blast furnace slags.

EXAMPLE VII

Porous granulated blast furnace slag produced according to the process of Example I is used as an embankment material for raising a ground surface.

Because of the low weight per unit volume the granulated steel slag hereof does not sink away into a soft substance or even a body of water. Consequently a ground surface can be brought to the desired height very successfully.

EXAMPLE VIII

The lower-ferrite fraction obtained according to the process of Example IV is used as a cement fraction, to replace Portland cement clinker or blast furnace granules. A self-setting cement is obtained which has the same characteristics as Portland cement or blast furnace cement, respectively.

Replacement of the lower-ferrite fraction by an amount of porous granulated steel slag gave comparable results.

On the other hand, although replacement of the amount of porous granulated steel slags by air-cooled and finely ground steel slags yielded a cement having a somewhat slower onset of setting, the product obtained, after hardening for 28 days, amply met the values specified for use as cement in respect of bending strength under tension and compression strength.

It is pointed out that the use of porous granulated steel slags as a cement constituent is economically advantageous because the grinding energy required for grinding to cement fineness can be appreciably restricted.

TABLE I

| CONTENTS IN % | NON-GRANULATED STEEL SLAG | | | GRANULATED STEEL SLAG |
|---|---|---|---|---|
| MgO | 2.4 | 2.6 | 2.7 | 3.3 |
| $Al_2O_3$ | 2.0 | 2.0 | 1.9 | 5.1 |
| $SiO_2$ | 14.4 | 15.1 | 14.7 | 25.4 |
| $P_2O_5$ | 1.5 | 1.6 | 1.5 | 1.0 |
| CaO, total | 49.6 | 49.7 | 49.8 | 58.8 |
| $TiO_2$ | 1.3 | 1.4 | 1.3 | 1.4 |
| MnO | 5.0 | 5.1 | 5.2 | 3.1 |
| Fe, total | 15.1 | 14.6 | 15.3 | 0.3 |
| of which: | | | | |
| free CaO | 6.3 | 5.5 | 5.6 | 0.1 |
| Met.Fe | 2.0 | 1.5 | 2.1 | x |
| FeO | 3.2 | 3.7 | 3.6 | x |
| Cd % | <.0001 | <0.0001 | <0.0001 | x |
| Cr ($Cr_2O_3$) % | 0.137 | 0.138 | 0.123 | <0.01 |
| Cu % | 0.0015 | 0.0012 | 0.0008 | x |
| Ni % | 0.0011 | 0.0007 | <0.0002 | x |
| Pb % | <0.001 | <0.001 | <0.001 | x |
| F % | 0.150 | 0.179 | 0.087 | x |
| S % | 0.146 | 0.180 | 0.112 | x |
| $Li_2O$ % | 0.010 | 0.010 | 0.003 | x |
| $Na_2O$ % | 0.458 | 0.596 | 0.179 | x |
| $K_2O$ % | 0.163 | 0.144 | 0.018 | x |
| V ($V_2O_5$) % | 0.311 | 0.335 | 0.548 | 0.23 |
| Zn % | | 0.0022 | 0.0007 | x |

x not determined

I claim:

1. A hydraulically setting binding material made by spraying a molten stream of steel slag having an original free calcium oxide content with a sprayed pressurized stream of water to form porous granulated particles having a free calcium oxide content of no more than 1/10 of the original content, and a weight per unit volume in the loosely dumped state of less than 1 kg/dm$^3$.

2. A hydraulically setting binding material according to claim 1, wherein the granulated porous steel slag has a weight per unit volume of less than 0.8 kg/dm$^3$ in the loosely dumped state and 0.99 kg/dm$^3$ in the compacted dumped state.

3. A hydraulically setting binding material according to claim 1, wherein the free calcium oxide content in the porous granulated steel slag is less than 1%.

4. A hydraulically setting binding material according to claim 1, wherein the porous granulated steel slag is obtained by spraying a molten stream of steel slag with a sprayed pressurized stream of water in an amount ranging from 4 to 8 tons water per ton of the molten steel slag.

5. A hydraulically setting binding material according to claim 1, wherein the porous granulated steel slag is a ground comminuted slag.

6. A hydraulically setting binding material according to claim 1, wherein the steel slag is a comminuted slag having an amount of lime corresponding with the amount of the non-comminuted slags.

7. A hydraulically setting binding material according to claim 5, wherein iron is removed from the comminuted porous granulated steel slag.

8. A hydraulically setting binding material according to claim 5, further comprising a separated comminuted porous granulated steel slag having a first fraction with a first ferrite content and a second fraction having a second ferrite content lower than the first ferrite content.

9. A method of making a hydraulically setting binding material comprising grinding steel slag obtained from a steel converter, melting the ground steel slag to form a molten steel slag; and spraying the molten steel slag with a pressured mist of water to obtain porous granules of steel slag.

10. A method of making a hydraulically setting binding material according to claim 9, further comprising removing ferromagnetic particles comprising iron from said ground steel slag with a magnet before melting the ground steel slag.

* * * * *